US007866297B2

(12) United States Patent
Murawsky

(10) Patent No.: US 7,866,297 B2
(45) Date of Patent: Jan. 11, 2011

(54) ROTARY HEAT ENGINE

(75) Inventor: Ronald Francis Murawsky, Clearwater, FL (US)

(73) Assignee: Ronald F Murawsky, Clearwater, FL (US)

( * ) Notice: Subject to any disclaimer, the term of this patent is extended or adjusted under 35 U.S.C. 154(b) by 0 days.

(21) Appl. No.: 12/586,458

(22) Filed: Sep. 23, 2009

(65) Prior Publication Data

US 2010/0071657 A1 Mar. 25, 2010

Related U.S. Application Data

(63) Continuation-in-part of application No. 11/299,291, filed on Dec. 12, 2005, now abandoned, which is a continuation of application No. 10/921,618, filed on Aug. 20, 2004, now abandoned.

(51) Int. Cl.

| | |
|---|---|
| ***F02B 53/00*** | (2006.01) |
| ***F01C 1/00*** | (2006.01) |
| ***F04C 18/00*** | (2006.01) |
| ***F04C 2/00*** | (2006.01) |

(52) U.S. Cl. ..... 123/241; 123/18 R; 418/34; 418/35

(58) Field of Classification Search ..... 123/241, 123/245, 223, 18 R, 18 A, 41 R, 43 B; 418/34–38
See application file for complete search history.

(56) References Cited

U.S. PATENT DOCUMENTS

| | | | | | |
|---|---|---|---|---|---|
| 706,730 | A | * | 8/1902 | Dupont | 418/34 |
| 1,212,649 | A | * | 1/1917 | Krikorian | 418/35 |
| 1,473,199 | A | * | 11/1923 | Peraza | 123/18 R |
| 1,739,104 | A | * | 12/1929 | Tropp | 418/35 |
| 1,888,300 | A | * | 11/1932 | Vastano | 185/41 R |
| 1,917,180 | A | * | 7/1933 | Zwick | 123/18 A |
| 2,001,810 | A | * | 5/1935 | Zwald | 188/82.3 |
| 2,170,213 | A | * | 8/1939 | Prew | 123/43 B |
| 4,279,577 | A | * | 7/1981 | Appleton | 418/35 |
| 5,330,333 | A | * | 7/1994 | Holmes | 418/35 |

* cited by examiner

*Primary Examiner*—Thai Ba Trieu

(57) ABSTRACT

A rotary internal combustion engine has two opposing rotary discs. Each rotary disc has a half-cylindrical chamber located around its perimeter. An outer casing encompasses both rotary discs. Intake and exhaust ports and necessary engine controls are formed in said outer casing. Pistons formed in each said disc. Half of said piston is connected permanently to one said rotary disc the other half of said piston slides in the half cylindrical chamber of the opposing said rotary disc. The pistons and cylindrical chambers develop varying volumes in each chamber, depending on the position of each disc and respective piston. These varying volumes perform different cycles common to four stroke piston engines. Mechanical devises allow the discs to rotate in only one direction. Mechanical devises allow the disc to engage output shaft in only one direction. From output shaft work can be derived.

1 Claim, 11 Drawing Sheets

FIG. 14
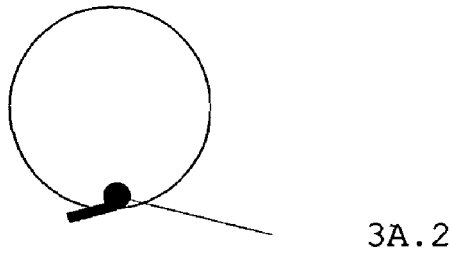
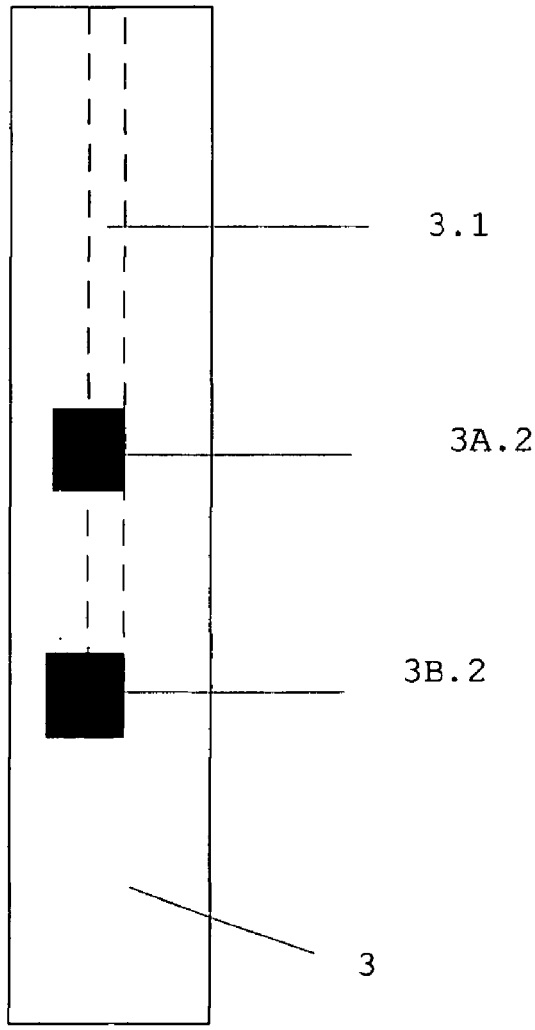
FIG. 13

ROTARY HEAT ENGINE

CROSS-REFERENCE TO RELATED APPLICATIONS

This application is Continuation-In-Part of U.S. patent application having Ser. No. 11/299,291 filed on Dec. 12, 2008 now abandoned, which is a Continuation of U.S. patent application having Ser. No. 10/921,618 filed on Aug. 20, 2004 now abandoned.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

FIELD OF THE INVENTION

This invention relates to enclosed chamber rotary heat engines.

BRIEF SUMMARY OF THE INVENTION

This invention performs all the necessary functions common to the internal combustion piston engine, but its inherent design eliminates the main drawbacks associated with a reciprocating piston engine. For instance, the main moving parts rotate, which maintains less stress on internal parts and less energy required to stop and start a piston moving on a linear path. Also the torque developed during the power stroke of this invention is greater because the force on the momentum arm remains perpendicular for the duration of the power stroke and the length of the momentum remains at its maximum for the duration of the power stroke.

BRIEF DESCRIPTION OF THE SEVERAL VIEWS OR THE DRAWINGS

FIG. 13 is a front view of the output shaft;

FIG. 14 is a top view of the output shaft;

Figure 2:
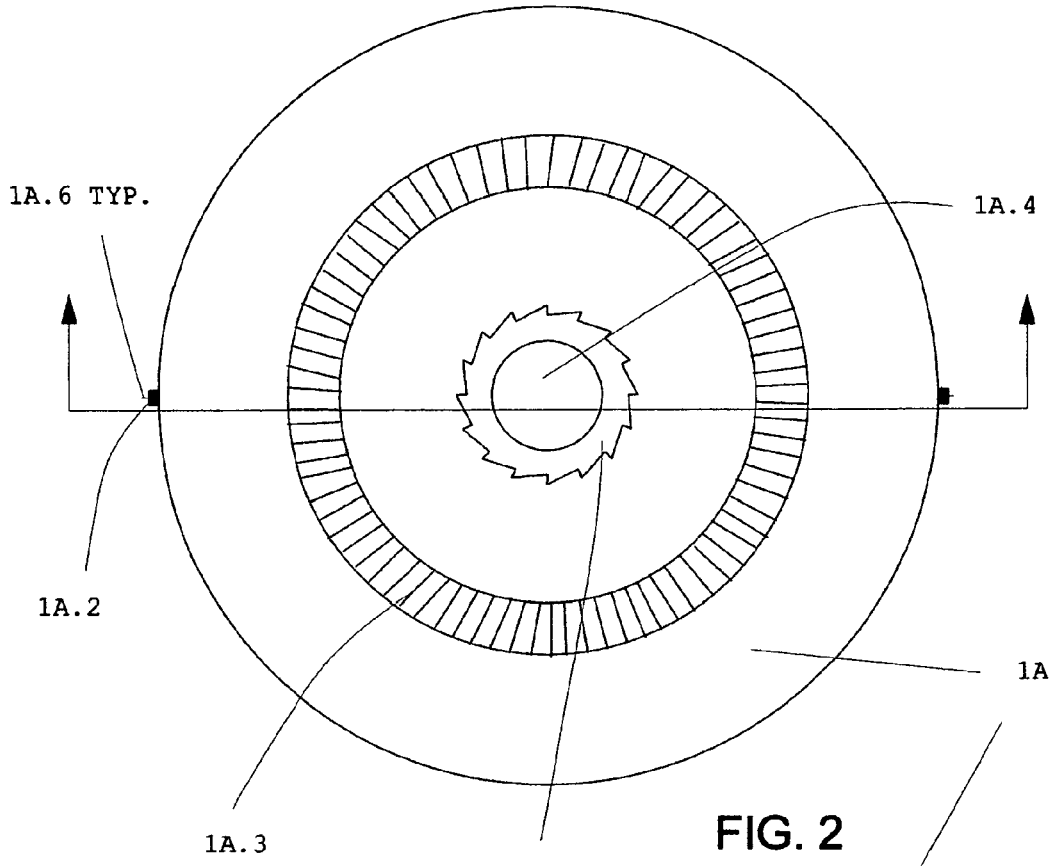
FIG. 2 is a top view of a rotary disc.
Figure 1:
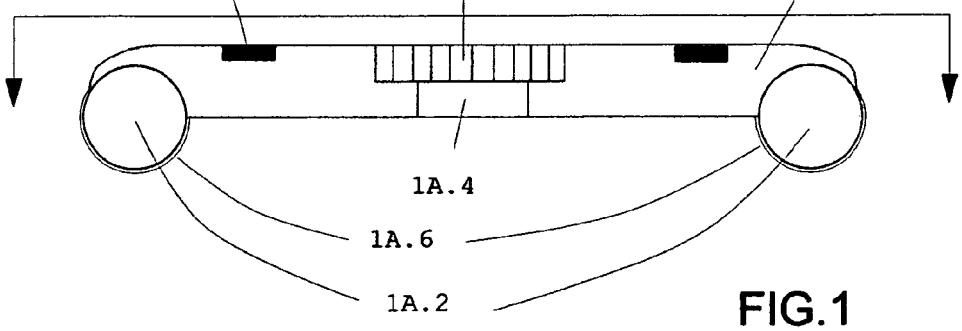
FIG. 1 is a sectional view of a rotary disc.
Figure 4:
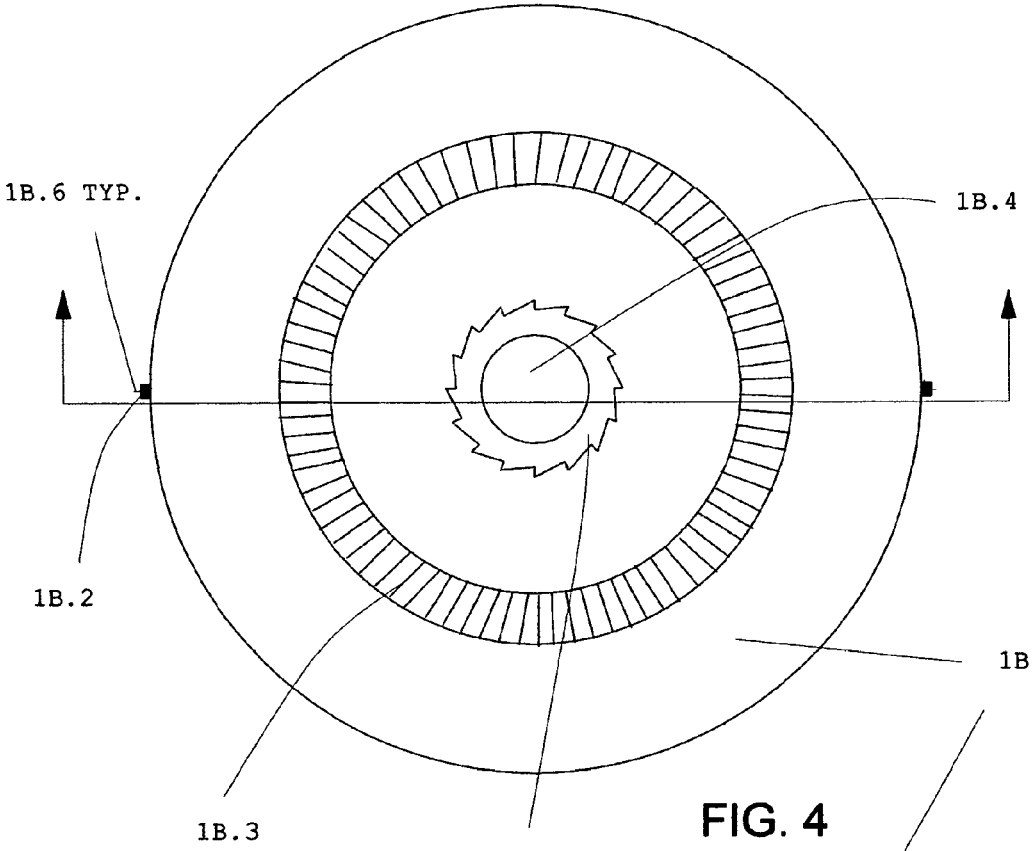
FIG. 4 is a top view of rotary disc.
Figure 3:
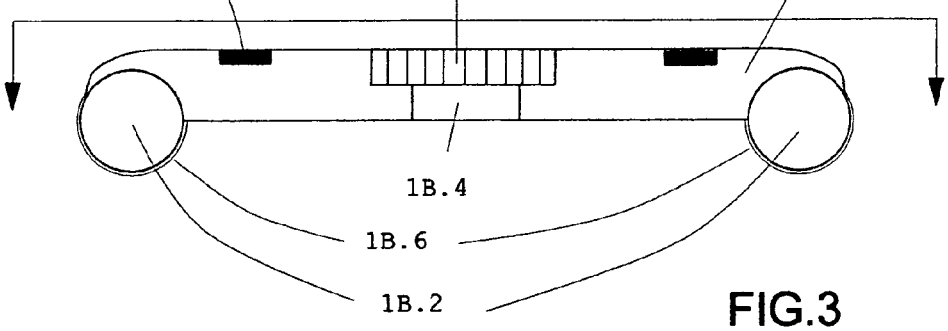
FIG. 3 is sectional view of rotary disc.
Figure 6:
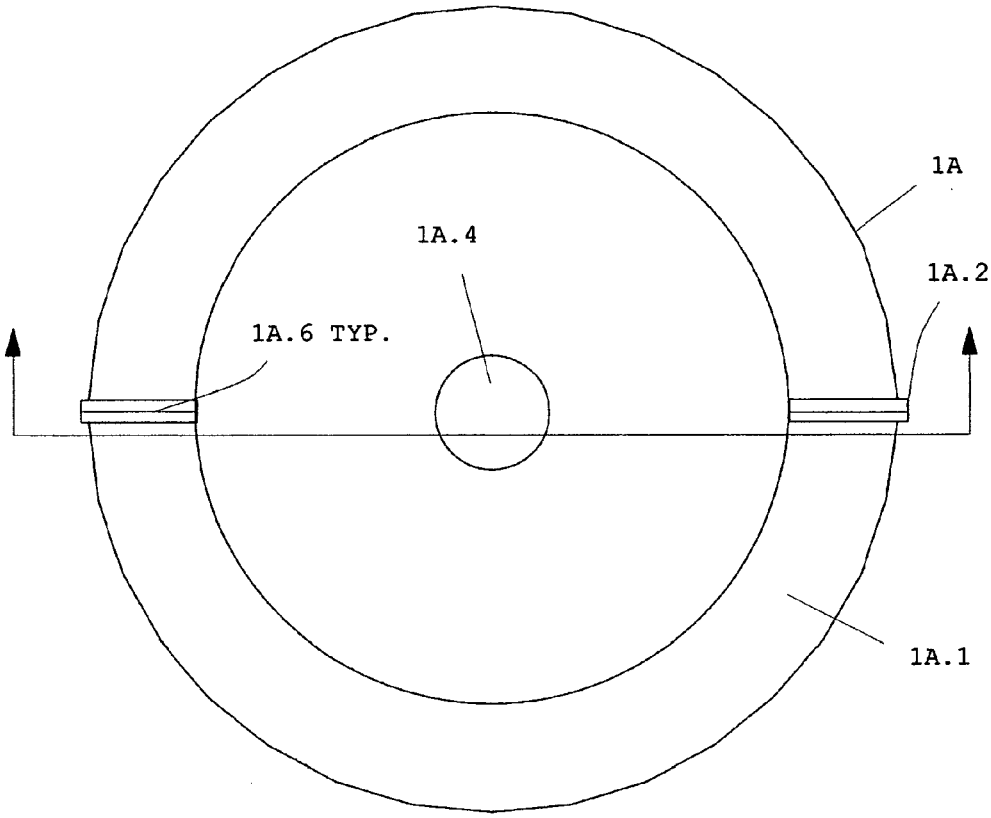
FIG. 6 is a top view of rotary disc.
Figure 5:
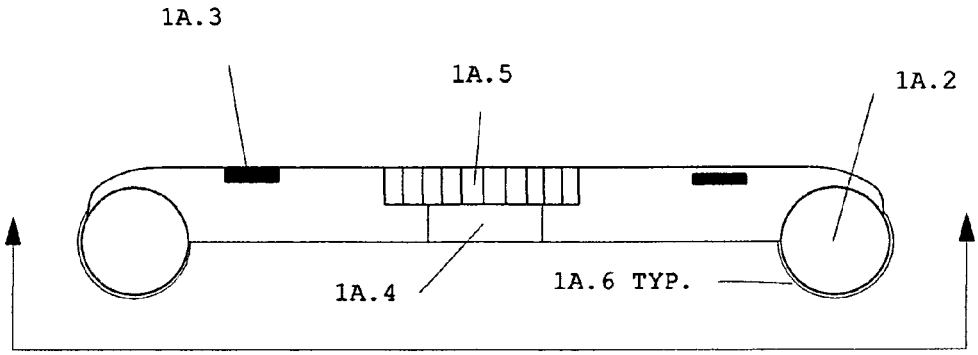
FIG. 5 is sectional view of rotary disc.
Figure 8:
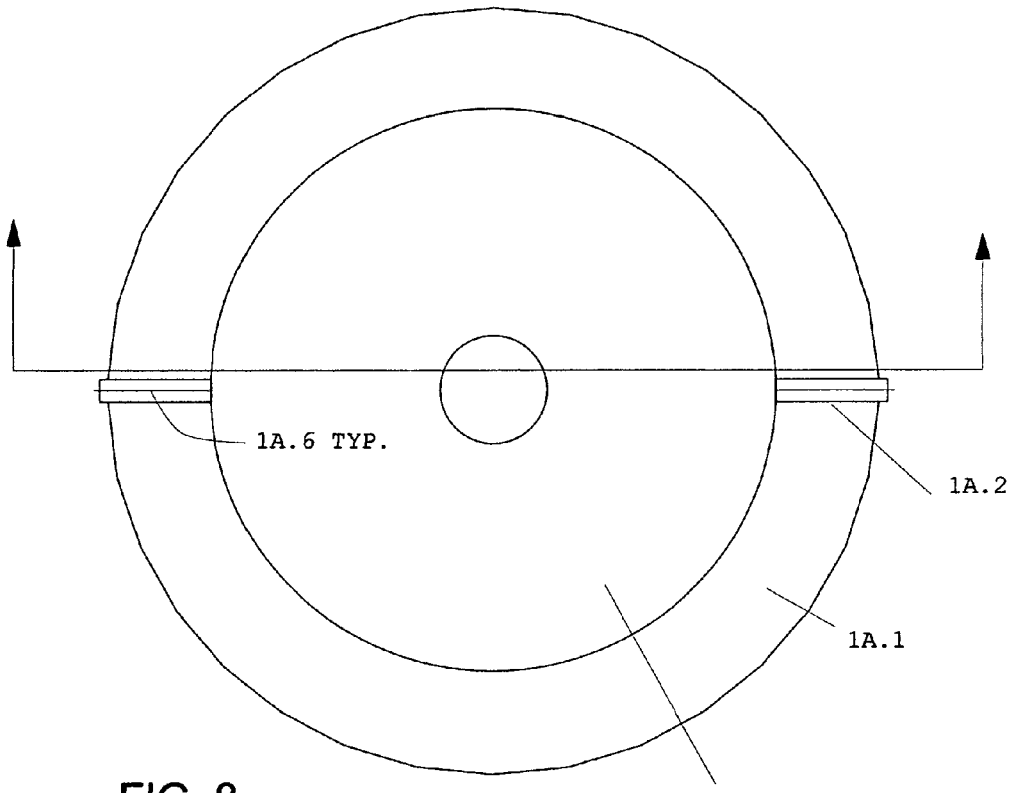
FIG. 8 is a top view of rotary disc.
Figure 7:
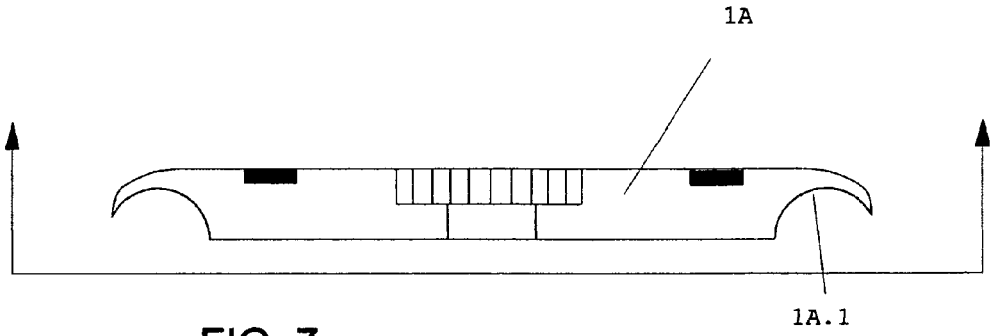
FIG. 7 is a sectional view of rotary disc.
Figure 10:
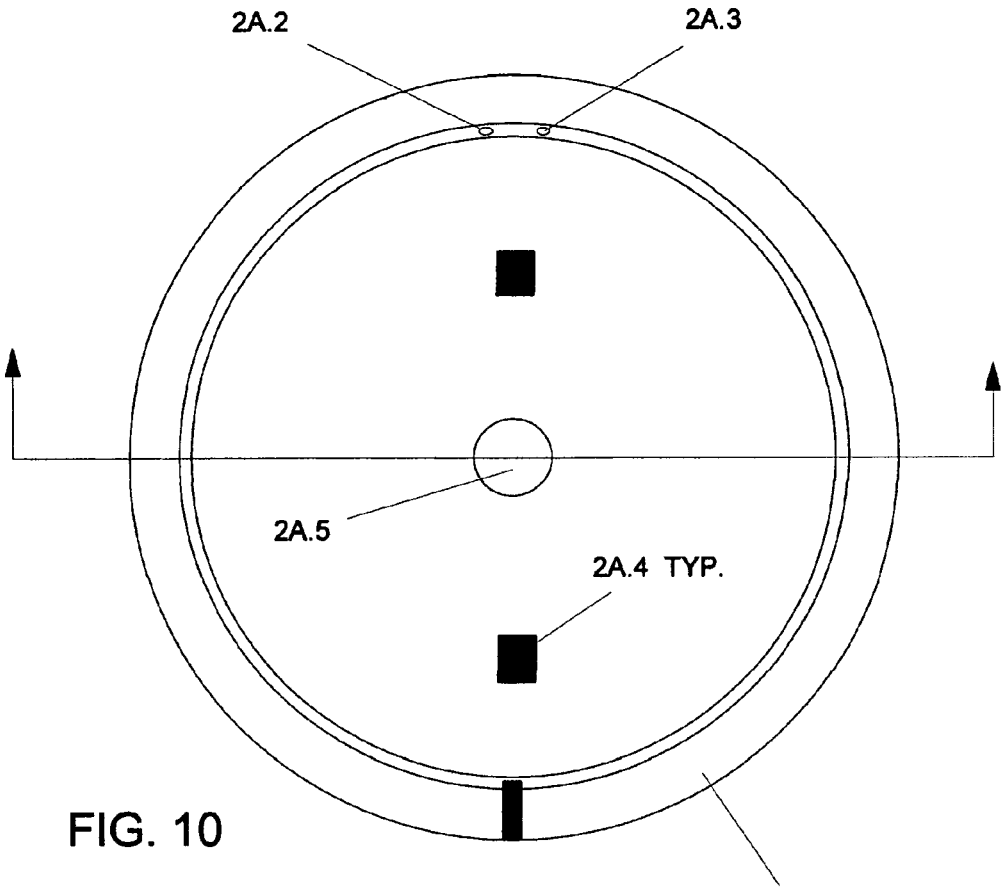
FIG. 10 is a top view of the exterior casing.
Figure 9:
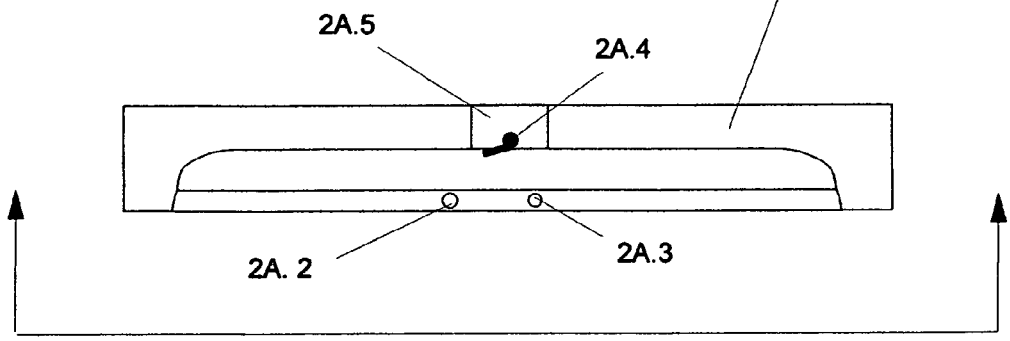
FIG. 9 is a sectional view of the exterior casing.
Figure 12:
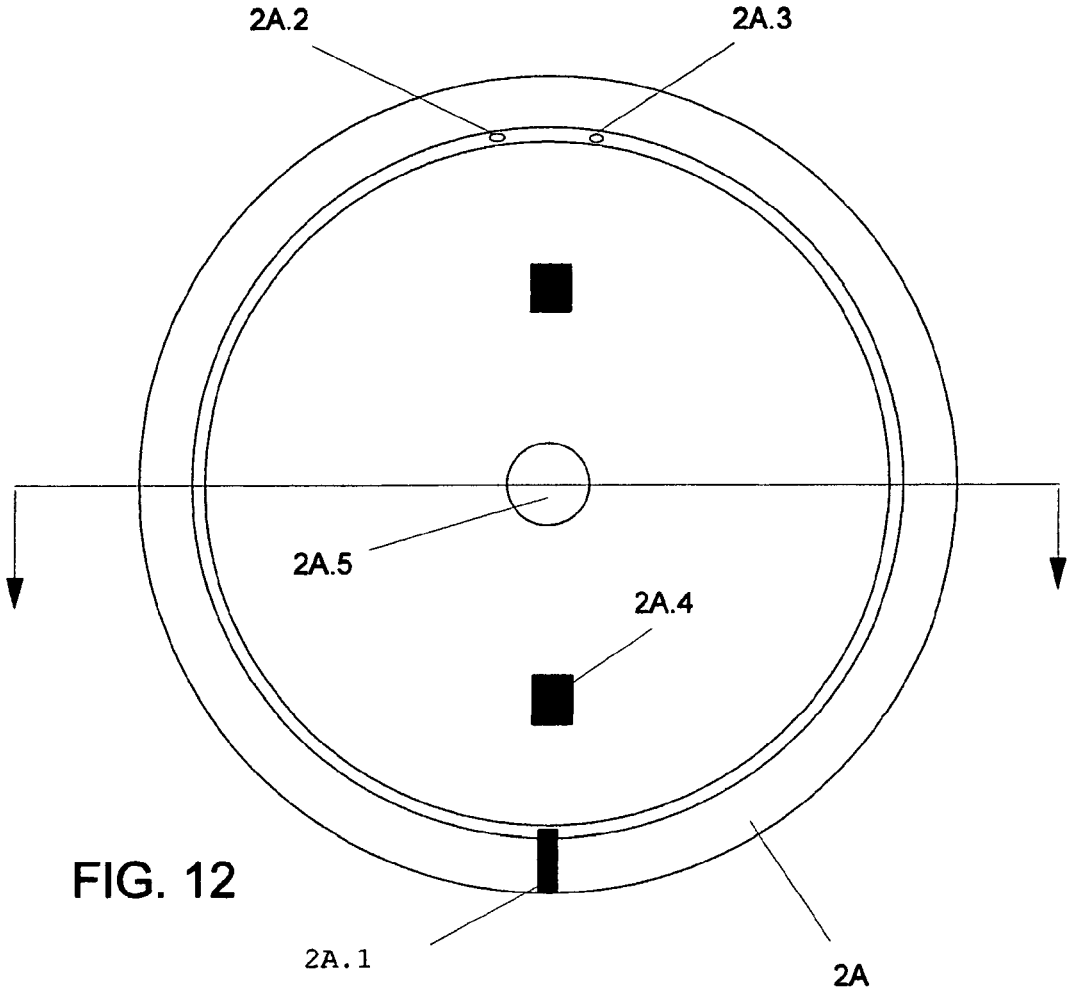
FIG. 12 is a top view of the exterior casing.
Figure 11:
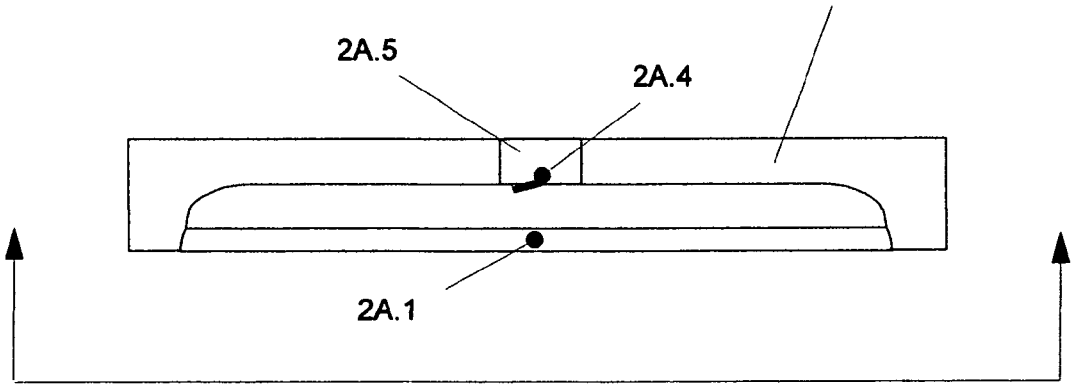
FIG. 11 is a sectional view of the exterior casing.
Figure 15:
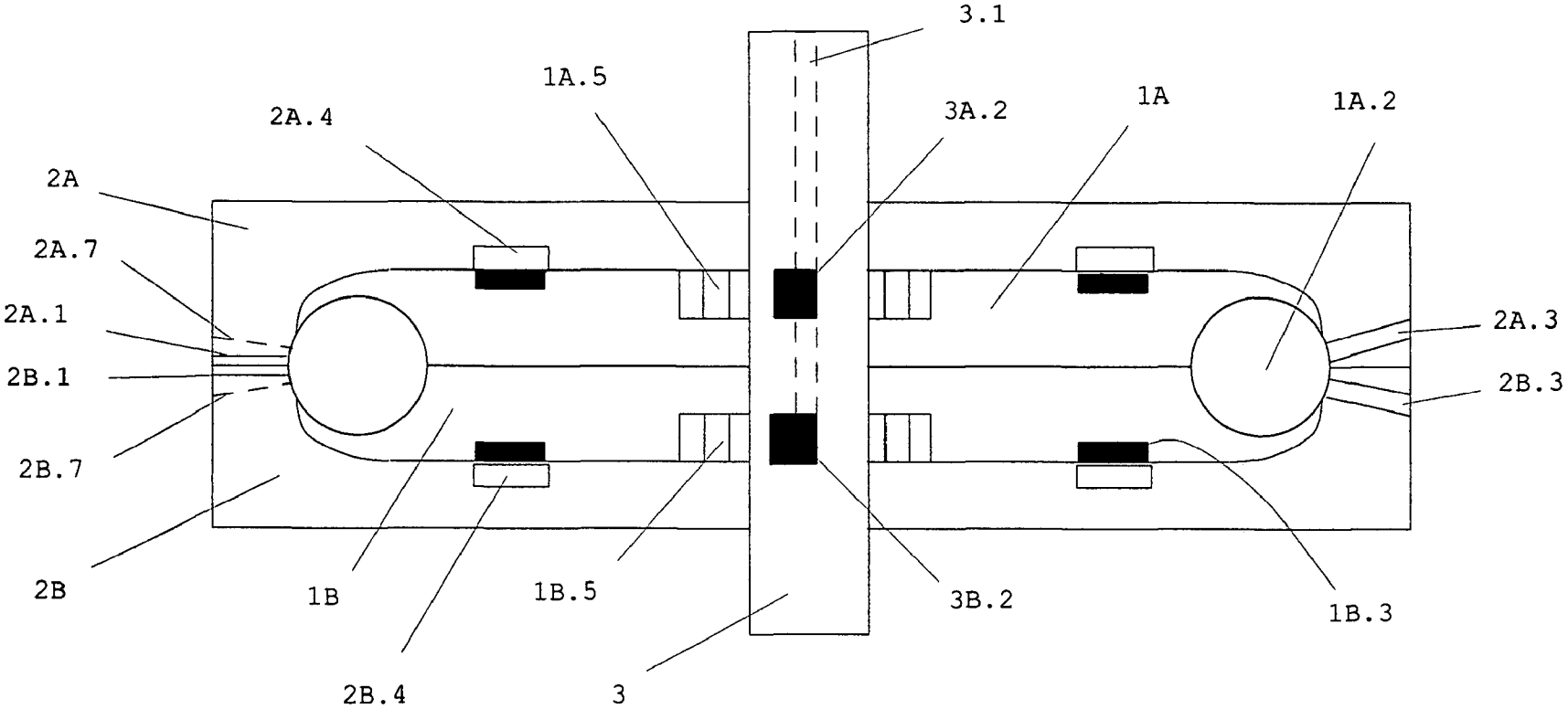
FIG. 15 is a composite sectional view of the complete engine.
Figure 16:
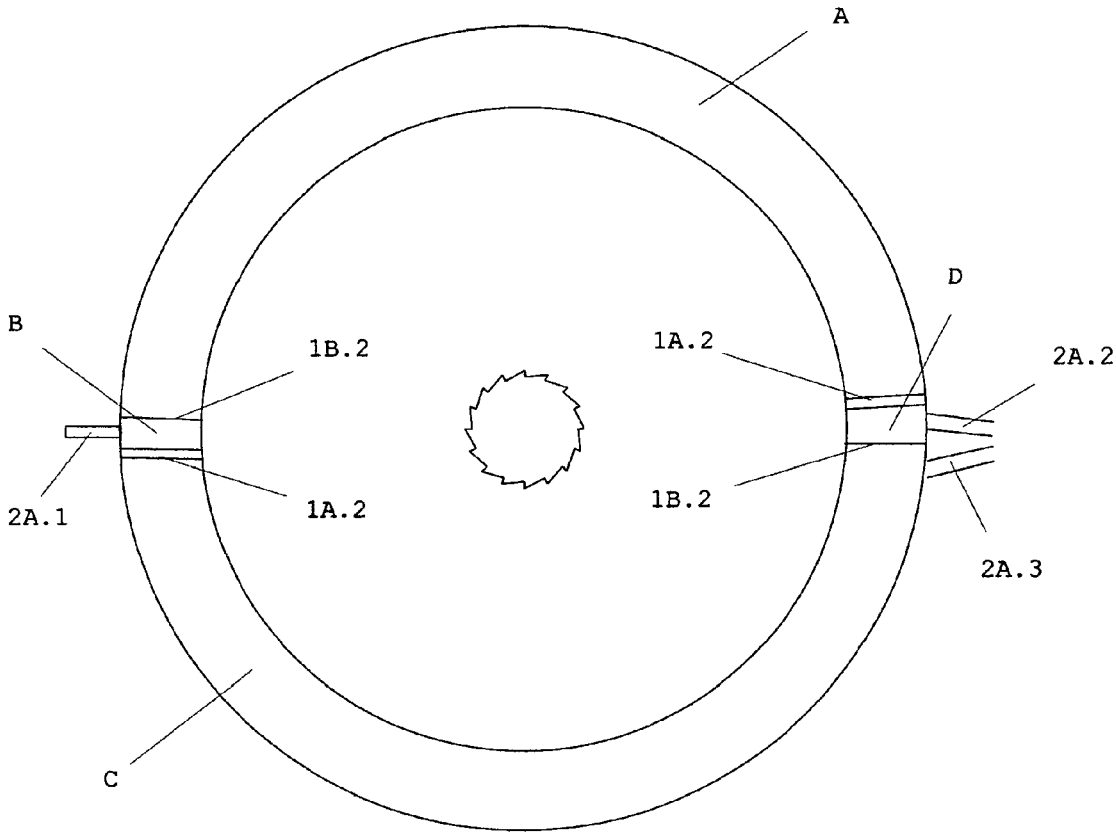
Figure 17:
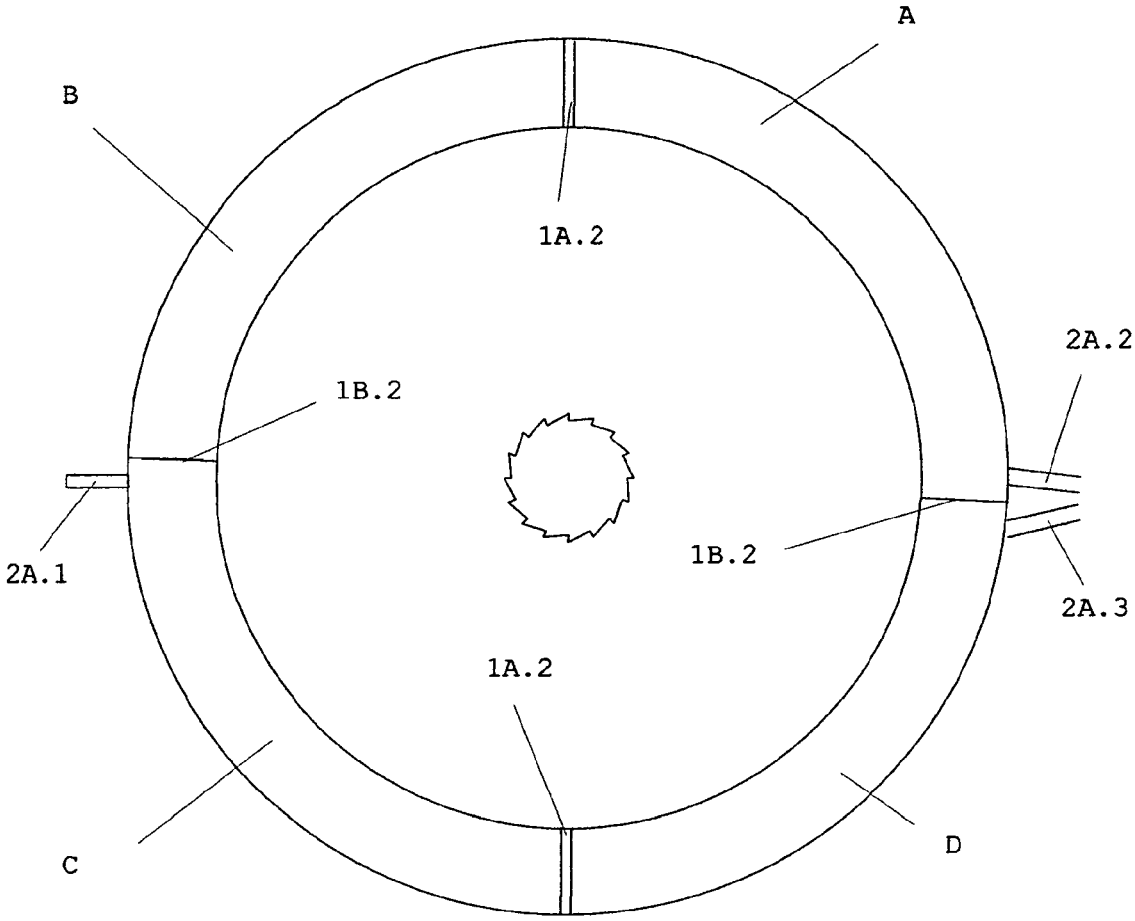
Figure 18:
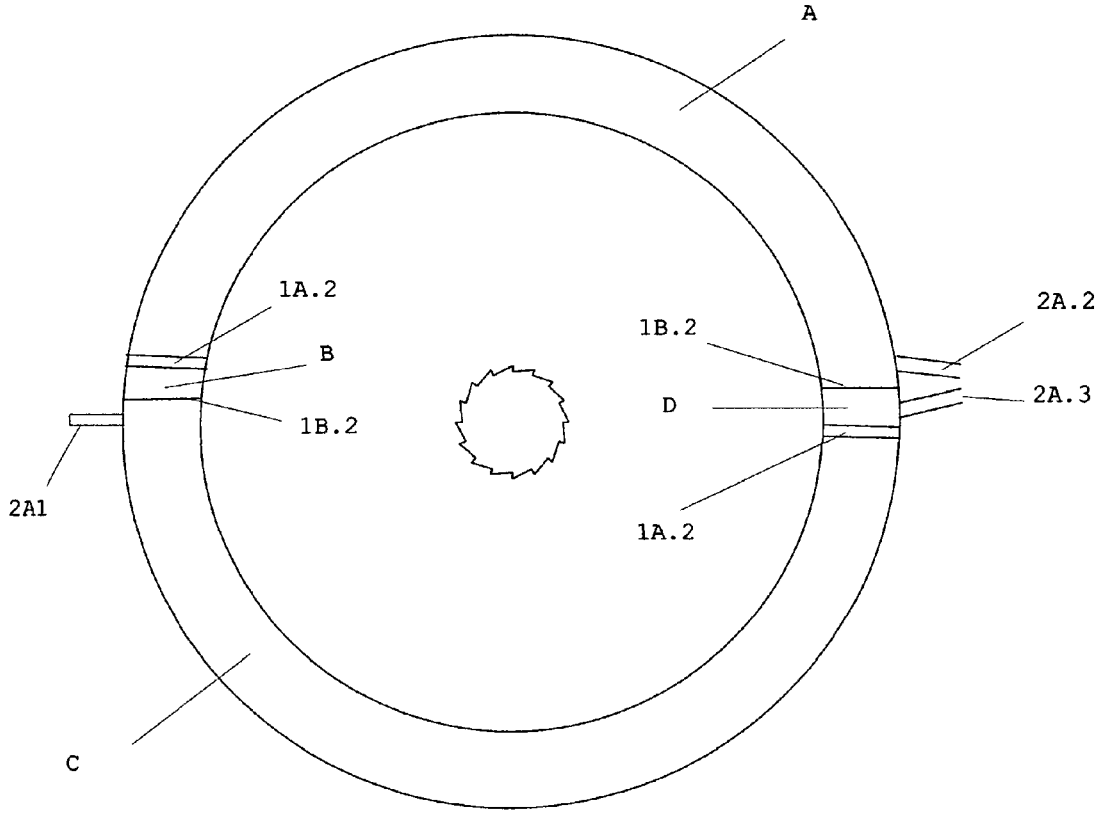

FIGS. 16-18 skeletal drawing depicting the inner functions.

DETAILED DESCRIPTION OF THE INVENTION

This invention relates to an internal combustion rotary engine that converts thermal energy into mechanical energy which comprises of two opposing rotary discs 1A, 1B. Each of the opposing rotary discs 1A, 1B is formed with a half toroidal chamber 1A.1, 1B.1 and located around perimeter two pistons 1A.2 are located approximately 180 degrees apart from each other in the toroidal chamber 1A.1. Each piston 1A.2 has two parts/portions. One portion/part of the piston 1A.2 is attached permanently to toroidal chamber 1A.1; and the other part/portion of the piston 1A.2 is unattached and slides inside the toroidal chamber 1B.1 of the opposing rotary disc 1B.

Seals 1A.6, 1B.6 are provided for minimizing air gap in areas of the rotary disc 1A, 1B and the pistons 1A.2, 1B.2 for preventing fluid leakage. An output shaft hole 1A.4, 1B.4 is located in the center of rotary disc 1A, 1B. An output shaft 3 passes through the concentric output shaft hole 1A.4, 1B.4. The center outer side of the rotary disc 1A, 1B is located on the output shaft 3 having ratcheting teeth 1A.5, 1B.5.

Exterior casings 2A, 2B are formed to fit the exterior of the rotary discs 1A, 1B. At least one spark plug 2A.1, 2B.1 is positioned on the exterior of the casings 2A, 2B. At least one intake port 2A.2, 2B.2 is formed approximately 180 degrees from the spark plug 2A.1, 2B.1. At least one exhaust port 2A.3, 2B.3 is formed approximately 180 degrees from the spark plug 2A.1, 2B.1. A circle of ratcheting teeth 1A.3, 1B.3 is formed on the exterior of the rotary discs 1A, 1B. At least one ratcheting lever 2A.4, 2B.4 is aligned with ratcheting teeth 1A.3, 1B.3. Ratcheting teeth 1A.3, 1B.3 combining with ratcheting lever 2A.4, and 2B.4 will allow the rotary discs 1A, 1B to rotate in only one direction. The output shaft 3 passes through the concentric output shaft hole 2A.5, 2B.5.

The output shaft 3 fits inside holes 1A.4, 1B.4, 2A.5, and 2B.5. The output shaft 3 incorporates at least one ratcheting lever 3A.2, 3B.2. Ratcheting lever 3A.2, 3B.2 pivots in and is assembled through slot 3.1. The ratcheting lever 3A.2, 3B.2 is aligned and works in conjunction with ratcheting teeth 1A.5, 1B5 for allowing the rotary discs 1A, 1B to engage output shaft to rotate in only one direction.

The spark plug 2A.1, 2A.1 ignites fluid mixture which causes combustion and produce force applied to pistons 1A.2, 1B.2. This force will cause rotary disc 1A, 1B to rotate counterclockwise. Connected to rotary disc 1A, 1B is the output shaft 3 from which work can be derived. The fluid mixture may also be ignited by the heat of compression commonly known in diesel engines. This would eliminate the need of a spark plug.

Running Phase of the Engine

FIG. 14.

Chamber A—in which low pressure fluid such as air and gasoline is to be filled.

Chamber B—Piston 1A.2 has just started rotating relativity slower due to the higher pressure fluid force from piston 1B.2 which is rotating at a faster rate which decreases the volume and pressurizes the combustion fluid. A spark is produced by a spark Plug 2A.1. Pressure is increasing rapidly from the heat of combustion. The increase in pressure applies force on piston 1B.2 causing it to move clockwise. Piston 1B.2 is attached to rotor 1B and rotor 1B has ratcheting teeth 1A.3 and ratcheting lever 2A.4 will not allow rotor 1B to rotate clockwise but will cause pistons 1B.2 to come to a stop and act as an abutment. The same increase in pressure applies force on pistons 1A.2 propelling it counterclockwise. It is this force which enables the engine to do work.

Chamber C—Piston 1B.2 is moving counterclockwise, passing exhaust port 2A.3 and exposing high pressure exhaust fluid from combustion to the atmosphere. Due to the imbalance in pressure the exhaust gas is discharged through exhaust port 2A.3 to the atmosphere.

Chamber D—Fluid beginning to move in intake port 2A.2.

FIG. 15.

Chamber A—Piston 1A.2 is rotating counterclockwise at a high rate. Piston 1B.2 is at rest. With volume increasing fluid from the atmosphere combined with a fuel such as gasoline is drawn in Intake Port 2A.2.

Chamber B—Piston 1A.2 is rotating counter clockwise at a high rate while piston 1B.2 is at rest. With volume decreasing combustionable fluid such as gasoline and air is compressed.

Chamber C—The force from combustion is acting on piston 1B.2 and piston 1A.2 causing the two pistons 1B.2 and 1A.2 to move apart. Piston 1B.2 cannot rotate clockwise because of ratcheting teeth 1A.3 and ratcheting lever 2A.4 therefore piston 1B.2 is at rest acting as an abutment. Piston 1A.2 is free to move counter clockwise from the force of combustion engaging output shaft 3 by means of ratcheting teeth 1A.5 and ratcheting lever 3A.2. From output shaft 3 work can be derived.

Chamber D—Piston 1A.2 is rotating counter clockwise at a high rate while piston 1B.2 is at rest causing the volume to decrease discharging high pressure exhaust fluid through exhaust port 2A.3 into relatively low pressure atmosphere.

FIG. 16.

Piston 1A.2 moving at a high rate is now beginning to slow due to volume decreasing and pressure increasing in chamber B which is filled with combustion able fluid.

Chamber A—Combustion able fluid such as air and gasoline is being drawn in intake port 2A.2

Chamber B—Filled with compressed combustion able fluid. This compressed combustion able fluid prevents pistons 1A.2 and pistons 1B.2 from engaging each other. The momentum from Pistons 1A.2 is acting on stationary Pistons 1B.2. Piston 1B.2 begins to rotate counterclockwise.

Chamber C—Filled with exhaust fluid.

Chamber D—All exhaust fluid is has moved out exhaust port 2A.3. The cycle now starts over.

The invention claimed is:

1. An enclosed chamber internal combustion engine comprises:

two rotary discs being opposite and having at least one half toroidal chamber located around the perimeter of said two rotary discs;

at least one piston located in each of said at least one half toroidal chamber;

wherein each of said two rotary discs, said at least one half toroidal chamber and said at least one piston rotate as one;

an exterior casing formed to fit an exterior of said two rotary discs further comprising:

at least one intake port;

at least one exhaust port; at least one spark plug ratcheting teeth;

at least one ratcheting lever;

an output shaft; and a concentric output shaft hole being at center of said two rotary discs;

wherein an approximately half perimeter of each said at least one piston is attached permanently to said at least one half toroidal chamber and another unattached half perimeter of said at least one piston slides inside said at least one half toroidal chamber, which is opposite to the previous at least one half toroidal chamber;

wherein said at least one piston located in said at least one toroidal chamber physically divides said at least one toroidal chamber into separate chambers;

wherein said two rotary discs oppositely rotate at different rates with one of said two rotary disc being at rest while the other opposite rotary disc rotates to vary volumes in said toroidal chambers;

wherein said two rotary discs are engaged with said ratcheting teeth and at least one ratcheting lever to allow said two rotary discs rotating in only one direction; and wherein said output shaft is engaged with said ratcheting teeth and at least one ratcheting lever to allow said output shaft rotating in only one direction.

* * * * *